US006843311B2

(12) United States Patent
Evans et al.

(10) Patent No.: US 6,843,311 B2
(45) Date of Patent: Jan. 18, 2005

(54) INVERTED LID SEALING PLATE FOR HEAT EXCHANGER

(75) Inventors: Bruce L. Evans, Burlington (CA); Mike St. Pierre, Hamilton (CA); Joe L. English, Calgary (CA)

(73) Assignee: Dana Canada Corporation, Oakville (CA)

( * ) Notice: Subject to any disclaimer, the term of this patent is extended or adjusted under 35 U.S.C. 154(b) by 84 days.

(21) Appl. No.: 10/266,963

(22) Filed: Oct. 8, 2002

(65) Prior Publication Data

US 2003/0201094 A1 Oct. 30, 2003

(30) Foreign Application Priority Data

Apr. 24, 2002 (CA) ..... 2383649

(51) Int. Cl.[7] ..... F28F 3/08
(52) U.S. Cl. ..... 165/167; 165/109.1; 165/916
(58) Field of Search ..... 165/166, 167, 165/906, 916

(56) References Cited

U.S. PATENT DOCUMENTS

| | | | | |
|---|---|---|---|---|
| 4,872,578 A | | 10/1989 | Fuerschbach et al. | |
| 4,892,136 A | * | 1/1990 | Ichihara et al. | 165/51 |
| 5,099,912 A | * | 3/1992 | Tajima et al. | 165/133 |
| 5,511,612 A | * | 4/1996 | Tajima et al. | 165/167 |
| 5,931,219 A | * | 8/1999 | Kull et al. | 165/51 |
| 6,182,746 B1 | | 2/2001 | Wiese | |
| 6,340,054 B1 | | 1/2002 | Schwarz et al. | |
| 6,595,271 B2 | * | 7/2003 | Komoda | 165/133 |
| 2002/0129926 A1 | * | 9/2002 | Yamaguchi | 165/41 |

FOREIGN PATENT DOCUMENTS

| | | |
|---|---|---|
| DE | 196 54 365 | 6/1998 |
| EP | 0 347 961 | 12/1989 |
| EP | 0 597 778 | 5/1994 |
| EP | 0623 798 | 2/1999 |

* cited by examiner

*Primary Examiner*—Allen Flanigan
(74) *Attorney, Agent, or Firm*—Ridout & Maybee LLP

(57) ABSTRACT

A stacked plate-type heat exchanger including a plurality of dish-shaped heat exchanger plates arranged one next to the other to form a nested heat exchanger plate stack. A plurality of first and second fluid flow channels are formed between the heat exchanger plates for first and second fluids respectively, and first fluid and second fluid chambers are formed in the stack in communication with the first and second fluid channels respectively. An end plate for the heat exchanger has an end plate central planar portion and a peripheral flange projecting from the end plate central planar portion, the peripheral flange of the end plate projecting in an opposite direction and sealably nested within the peripheral flange of a final heat exchanger plate in the plate stack. A planar reinforcing plate is secured to an inner surface of the end plate central planar portion between the end plate central planar portion and the final heat exchanger plate, a further fluid channel for one of the first and second fluids being located between the planar reinforcing plate and the final heat exchanger plate.

17 Claims, 4 Drawing Sheets

INVERTED LID SEALING PLATE FOR HEAT EXCHANGER

This application claims priority to Canadian Application No. 2,383,649 filed Apr. 24, 2002.

BACKGROUND OF THE INVENTION

This invention relates to heat exchangers of the type formed from dish-shaped heat exchanger plates.

One form of plate-type heat exchangers includes a plurality of plates secured together in a stacked assembly with gaskets or bosses located between adjacent plates and traversing a course adjacent to the plate peripheries. Flow of two fluids involved in heat exchange is through alternate layers defined by the stacked plates. The stacked plates are typically joined together as a unitary structure by brazing the various components together. Examples of such plate-type heat exchangers are disclosed, for example, in U.S. Pat. No. 5,931,219 issued to Kull et al. and U.S. Pat. No. 4,872,578 issued to Fuerschbach et al.

A characteristic of previously proposed nested-dish heat exchangers is that in order to provide strength to the heat exchanger stack, the heat exchanger plates are typically sandwiched between a pair of thicker end plates. One of the end plates is typically nested within the flange of the final plate in the stack of the heat exchanger plates with the peripheral flange of the final heat exchanger plate extending a substantial distance beyond an outer surface of such end plate. Such a configuration can result in wasted space, namely, the area surrounded by the portion of the peripheral flange on the final heat exchanger plate that extends beyond the outer surface of the end plate. Additionally, the extending flange edge can provide a sharp edge such that care must be used in handling the heat exchanger to avoid injury to the person handling the heat exchanger. Accordingly, there is a need for a nested dish plate-type heat exchanger that reduces unused space. A plate-type heat exchanger which reduces the exposed peripheral flange of the final heat exchanger plate in the stack of plates is also desired.

SUMMARY OF INVENTION

In the present invention, an dish-type end plate configuration is used so that a fluid flow channel can be located between the end plate and the final heat-exchanger plate in the stack of heat exchanger plates, thereby reducing unused space in the stack and reducing the extent to which the flange on the final nested dish heat exchanger plate is exposed.

According to one aspect of the invention, there is provided a heat exchanger including a first plate having a central planer portion and a peripheral flange projecting therefrom, a second plate having a central planar portion and a peripheral flange projecting therefrom, and a reinforcing plate secured to substantially an entire inner surface of the central planar portion of the second plate, an inner surface of the central planar portion of the first plate spaced apart from and opposing the reinforcing plate and the peripheral flange of the second plate projecting in an opposite direction than the peripheral flange of the first plate and having an outer surface that overlaps with an inner surface of the peripheral flange of the first plate, the overlapping surfaces being sealably joined together, a fluid flow channel having a flow inlet and a flow outlet being defined by the first and second plates and reinforcing plate.

According to one aspect of the invention, there is provided a stacked plate-type heat exchanger including a plurality of dish-shaped heat exchanger plates arranged one next to the other to form a nested heat exchanger plate stack, each of the heat exchanger plates having a planar central portion with a peripheral flange projecting therefrom, a plurality of first and second fluid flow channels formed between the heat exchanger plates for first and second fluids respectively. The heat exchanger has first fluid and second fluid chambers formed in the stack in communication with the first and second fluid channels respectively, and includes an end plate with an end plate central planar portion and a peripheral flange projecting from the end plate central planar portion, the peripheral flange of the end plate projecting in an opposite direction and sealably nested within the peripheral flange of a final heat exchanger plate in the plate stack. A planar reinforcing plate is secured to an inner surface of end plate central planar portion between the end plate central planar portion and the final heat exchanger plate, a further fluid channel for one of the first and second fluids being located between the planar reinforcing plate and the final heat exchanger plate.

According to another aspect of the invention, there is provided a stacked plate-type heat exchanger including a plurality of heat exchanger plates sealably secured together to form a stack, each of the heat exchanger plates having a planar central portion and inlet and outlet passages for fluid passage, a plurality of fluid channels being defined between the planar central portions, some of the fluid channels being channels for a first fluid and some of the fluid channels being channels for a second fluid to facilitate heat exchange between the first and second fluids, at least a final heat exchanger plate in the stack having a peripheral flange projecting from the planar central portion thereof. The heat exchanger has an end plate having an end plate central planar portion and a peripheral flange projecting from the end plate central planar portion, the peripheral flange of the end plate projecting in an opposite direction and sealably located within and secured to the peripheral flange of the final heat exchanger plate, a further fluid channel for one of the first and second fluids being located between the end plate and the final heat exchanger plate.

BRIEF DESCRIPTIONS OF THE DRAWINGS

Preferred embodiments of the invention will now be described, by way of example, with reference to the accompanying drawings, throughout which like numerals are used to refer to like components.

DESCRIPTION OF THE PREFERRED EMBODIMENTS

Figure 1:
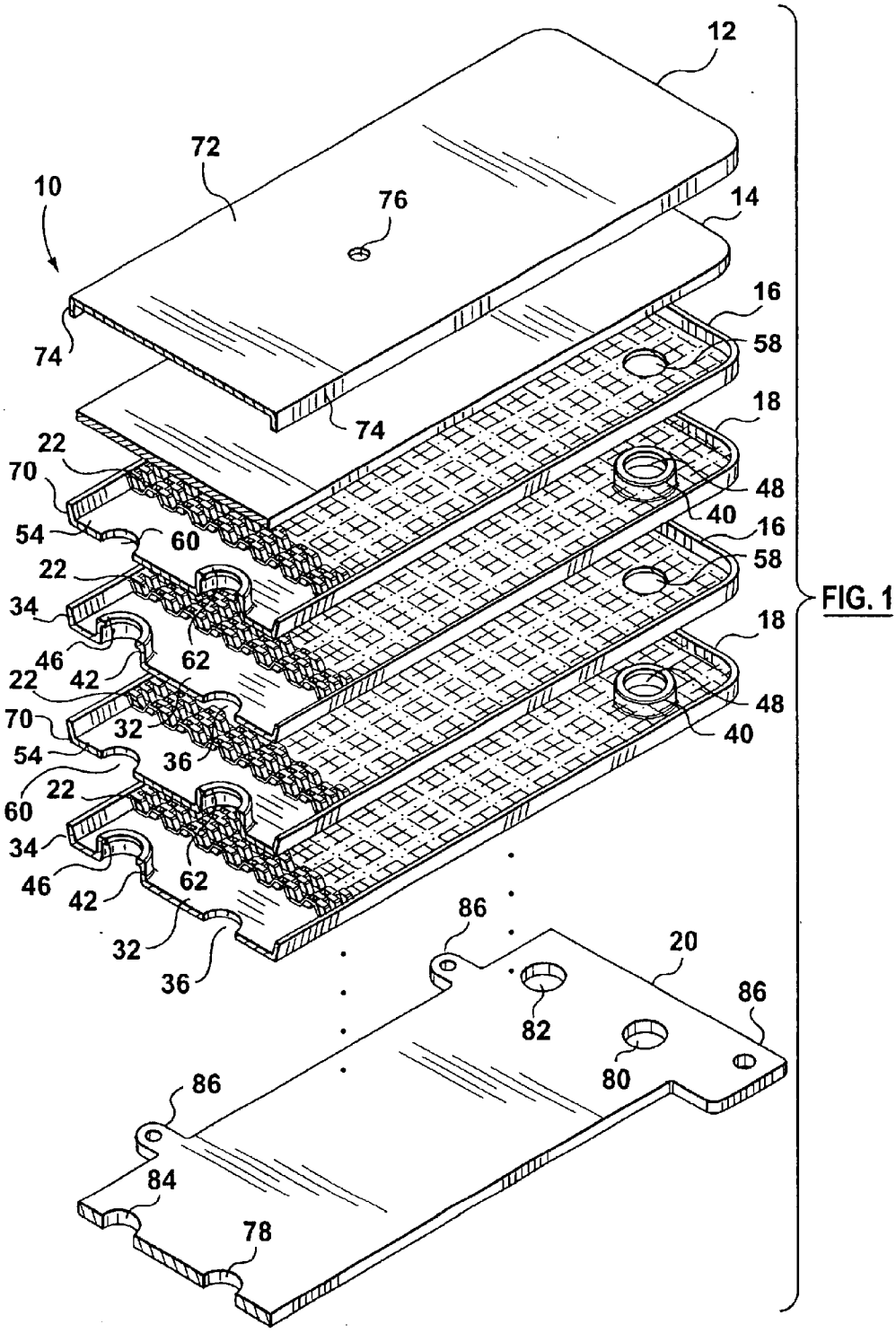
FIG. 1 is an exploded perspective view of a first preferred embodiment of a stacked plate-type heat exchanger made in accordance with the present invention.

Referring firstly to FIG. 1, an exploded perspective view of a preferred embodiment of a stacked-plate type heat exchanger according to the present invention is generally indicated by reference number 10. The heat exchanger 10 includes an end plate 12, a reinforcing plate 14, a number of alternating nested dish plates 16 and 18, and a connector plate 20. Plates 12 through 20 are shown arranged vertically in FIG. 1, but this is only for the purposes of illustration. The heat exchanger 10 can have any orientation desired.

Figure 2:
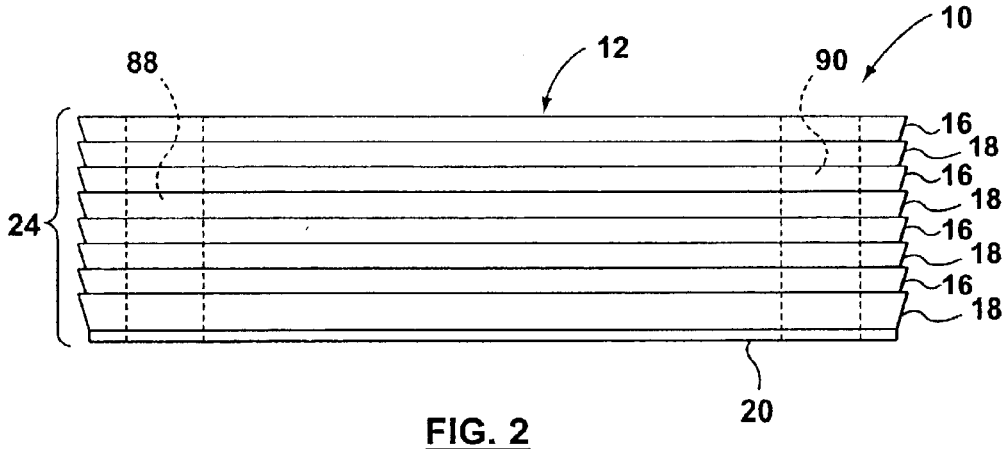
FIG. 2 is a side view of the assembled heat exchanger of FIG. 1.
Figure 3:
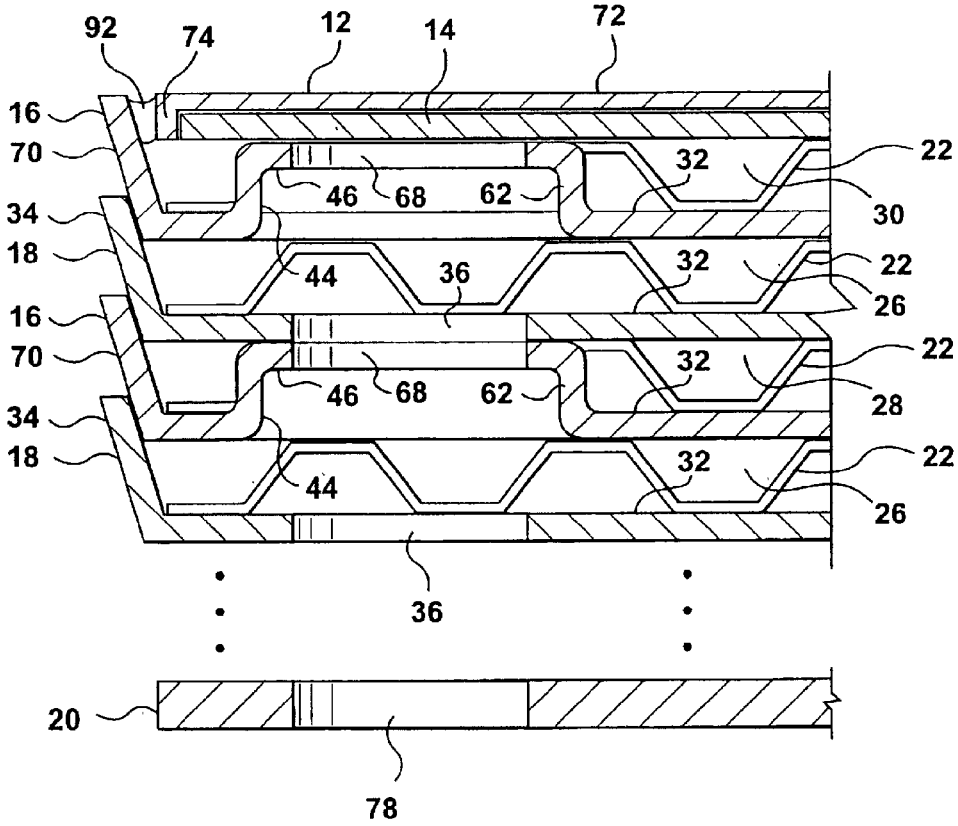
FIG. 3 is an enlarged partial elevational view of the assembled heat exchanger of FIG. 1.

In one preferred embodiment, the plates 12–20 are each formed from braze clad aluminum or aluminum alloy, however, other materials such as stainless steel or copper alloy, for example, could also be used. With reference to FIG. 2, the dish-style heat exchanger plates 16 and 18 are alternatively stacked one next to the other to form a core heat exchanger stack 24. With reference to FIG. 3, first fluid flow channels 26 and second fluid flow channels 28 for respective first and second fluids are alternatively defined between the heat exchanger plates 16 and 18 throughout the core stack 24. A final fluid flow channel 30 is defined between the reinforcing plate 14 and the final dish heat exchanger plate 16 (which is the top heat exchanger plate 16 shown in the Figures). Turbulizer plates 22, which in the illustrated embodiment includes off-set rows of convolutions, are located in the flow channels 26, 28 and 30 to augment the flow of fluids therethrough and also provide support to the adjacent plates.

Figure 4:
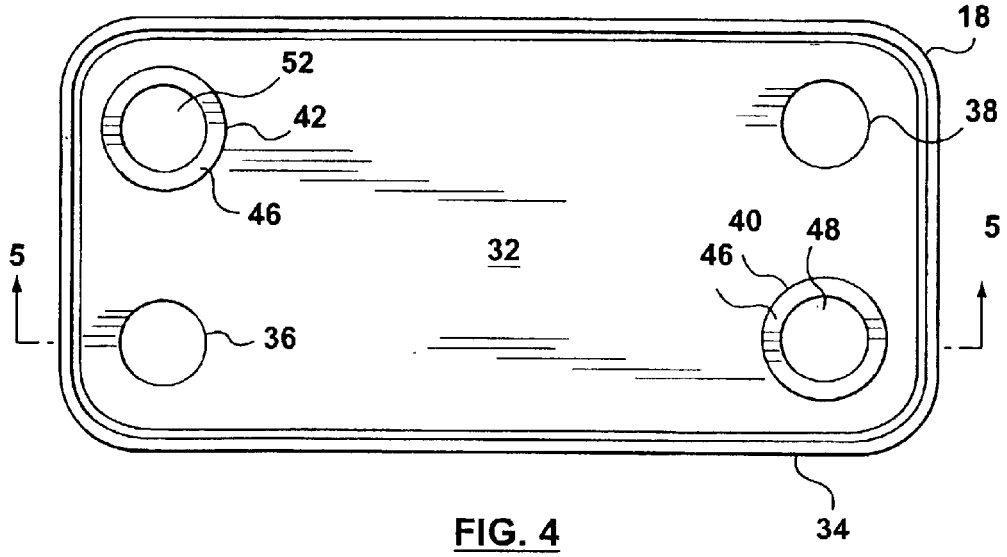
FIG. 4 is a plan view of one of the heat exchanger plates used in the heat exchanger of FIG. 1.
Figure 5:
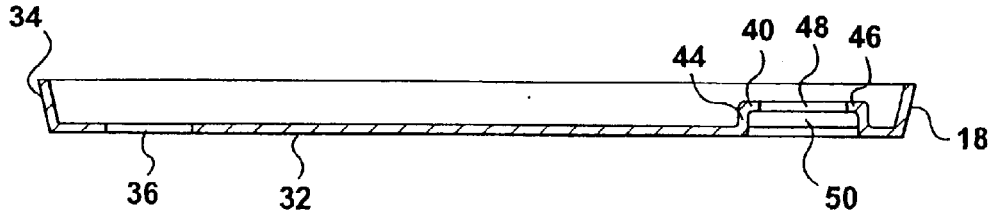
FIG. 5 is a sectional view taken along the lines 5—5 of FIG. 4.

With reference to FIGS. 1, 4 and 5, the construction of dish-shaped heat exchanger plates 16 and 18 will now be explained in greater detail. The heat exchanger plate 18 shown in FIGS. 4 and 5 includes a rectangular planar central portion 32 having an integral, peripheral, upwardly extending flange 34.

The flange 34 defines an angle of slightly greater than 90° with respect to the planar central portion 32. First and second flow openings 36 and 38 pass through the planar central portion 32, one of which functions as a first fluid inlet passage and the other of which functions as a first fluid outlet passage. Preferably, the flow openings 36 and 38 are diagonally located relative to each other near diagonally opposite edges of the planar portion 32, as illustrated in FIG. 4. However, the flow openings 36, 38 could also be located in different locations; for example, they could both be located the same distance from a common edge, of the plate. The heat exchanger plate 18 also includes raised first and second bosses 40, 42 that are integrally formed with the planar central portion 32. Each of the bosses 40, 42 includes an annular wall 44 that terminates at an annular support portion 46. The annular support portion 46 of the first boss 40 defines an opening 48 that communicates with a flow passage 50 that is defined by the annular wall 44 of the boss 40. Similarly, the annular support portion 46 of the second boss 42 defines an opening 52 that communicates with a flow passage defined by the annular wall 44 of the boss 42.

Figure 6:
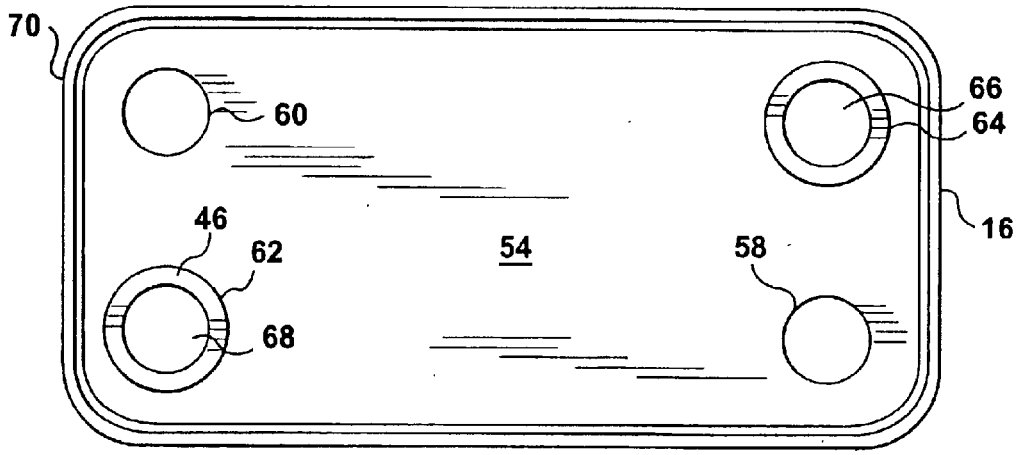
FIG. 6 is a plan view of a further heat exchanger plate used in the heat exchanger of FIG. 1.

The alternating heat exchanger plates 16 are substantially identical to heat exchanger plates 18 and thus each include, with reference to FIG. 6, a planar central portion 54, first and second flow openings 58, 60, respectively, and first and second bosses 62 and 64, respectively, each of which define a flow opening 66 and 68, respectively. Integral peripheral flange 70 extends from the planar central portion 54.

Heat exchange plates 16 and 18 are, in a preferred embodiment, identical with the one exception that the locations of the bosses and flow openings are reversed between the plates 16 and 18, as is readably apparent from a comparison of FIGS. 4 and 6. In particular, the first boss 40 on plate 18 is located in a position corresponding to the location of the first flow opening 58 in alternative plate 16. The second boss 42 on plate 18 is located in a position corresponding to the location of the second flow opening 60 through alternative plate 16. The first flow opening 36 through plate 18 is located in a position corresponding to the location of the first boss 62 through alternating plate 16, and the second flow opening 38 through plate 18 is located in a position corresponding to the location of the second boss 64 of alternating plate 16. The flow openings 36 and 38 (and corresponding bosses) need not be diagonally located, but could be for example longitudinally located on the plate relative to each other.

Figure 7:
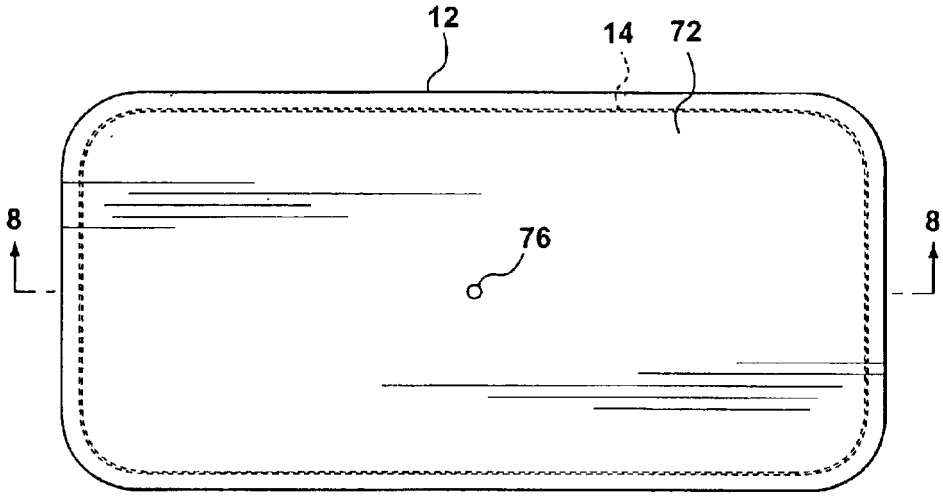
FIG. 7 is a plan view of an end plate of the heat exchanger of FIG. 1.
Figure 8:
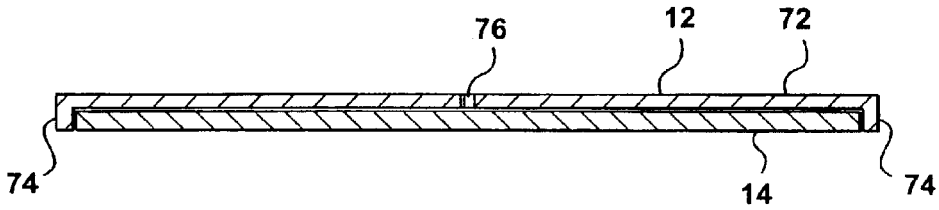
FIG. 8 is a sectional view take along the lines 8—8 of FIG. 7.

With reference to FIGS. 1, 7 and 8, the end plate 12 includes a planar central end plate portion 72 that is surrounded by integral, peripheral, downwardly extending flange 74. The reinforcing plate 14 is a substantially planar member that has a size substantially close to that of the planar central end plate portion 72, and which is nested within flange 74. For reasons which will be explained in greater detail below, an error proofing hole 76 is preferably provided through the planar central end plate portion 72.

In one embodiment, the central planar portions of plates 12, 16 and 18 are each formed from material of the same thickness, with reinforcing plate 14 being formed from a thicker material sufficient to provide necessary strength for the final flow channel.

With reference to FIGS. 1 and 2, the core stack 24 sits on a connector plate 20, which will typically be made of thicker material than the planar portions of plates 12, 16 and 18. The connector plate 20 has a footprint that corresponds largely to the central planar portion 32 of the first heat exchanger plate (which in FIG. 2 is the bottom plate 18) in the core stack 24. Connector plate 20 has first fluid first and second ports 78 and 82 formed therethrough, one of which functions as a first fluid inlet port, and the other of which functions as a first fluid outlet port for the heat exchanger 10. The connector plate 20 also has formed therethrough second fluid first and second ports 80 and 84, one of which functions as a fluid inlet port and the other of which functions as a fluid outlet port for the second fluid used in heat exchanger 10. The connector plate 20 may include one or more laterally extending connector portions 86 that have openings formed therethrough to permit the heat exchanger 10 to be secured or mounted in place.

With reference to the Figures, and in particular FIGS. 1–3, assembly of the components of the heat exchanger 10 will now be described in greater detail. The core stack 24 is made up of alternating stacked dish-style heat exchanger plates 16 and 18. As best seen in FIG. 3, an outer lower portion of the flange 70 of each heat exchanger plate 16 is received within an inner upper portion of the flange 34 of an adjacent lower heat exchanger plate 18. Similarly, each heat exchanger plate 18 (with the exception of the first heat exchanger plate 18 in the stack 24) has a lower outer portion of its flange 34 received within an upper inner portion of the flange 70 of an adjacent lower heat exchanger plate 16. In such a manner, the flanges of the heat exchanger plates 16, 18 each receive and support (with the exception of the top or end heat exchanger plate 16 in the stack 24) an adjacent heat exchanger plate 18, 16, respectively. The bosses 40, 42, 62 and 64 and the turbulizer plates 22 located between the plates provide further support for the plates.

The first fluid flow channels 26 are defined between the bottom surfaces of the central planar portions 54 of heat exchanger plates 16 and the upper surfaces of the central planar portions 32 of the heat exchanger plates 18. Similarly, the second fluid flow channels 28 are defined between an upper surface of the central planar portion 54 of the heat exchanger plate 16 and the lower surfaces of the central planar portions 32 of the heat exchanger plates 18. As best seen in FIG. 3, in the assembled heat exchanger 10, the first fluid first port 78 through connector plate 20, the first flow openings 36 through the plates 18, and the openings 68 through the first bosses 62 of the alternating heat exchanger plates 16 are all in alignment with each other thereby providing a first fluid flow chamber for the first fluid, indicated by phantom line 88 in FIG. 2, that is in flow communication with each of the first fluid flow channels 26. The annular wall 44 and planar support portion 46 of each of the first bosses 62 of the heat exchanger plates 16 isolate the second fluid flow channels 28 from the first fluid flow chamber 88.

As can best be appreciated from FIG. 3, the annular walls 44 and planar support portions 46 of each of the bosses 62 are sized such that an upper surface of the planar support portion 46 of the boss 62 sealingly engages a bottom surface of the planar central portion of adjacent higher plate 18 about the circumference of the first flow opening 36. The bosses 40, 42 and 64 are each similarly configured to provide a similar function in the proximity of the other three corners of the heat exchanger stack 24.

The second port 82 for the first fluid is aligned with the second flow openings 38 through the plates 18 and the openings 66 through the second bosses 64 in alternating plates 16 to provide a second flow chamber for the first fluid that is in communication with the first fluid flow channels 26. One of the first fluid flow chamber 88 and the second fluid flow chamber for the first fluid functions as an inlet chamber, and the other as an outlet chamber.

The first port 80 for the second fluid is aligned with the openings 48 through the first bosses 40 of the heat exchanger plates 18 and the openings 58 of the plates 16 to provide a flow chamber for the second fluid, as indicated conceptually by phantom line 90 in FIG. 2, that is in flow communication with the second fluid flow channels 28 and further flow channel 30. The second port 84 for the second fluid aligns with the openings 52 through the bosses 42 of plates 18 and the openings 60 of plates 16 to provide a further fluid flow chamber for the second fluid that is in communication with the fluid flow channels 28 and further flow channel 30. One of the fluid flow chamber 90 and the further fluid flow chamber for the second fluid functions as an inlet chamber, and the other as an outlet chamber.

The peripheral flange 74 of the end plate 12 projects in an opposite direction than the flange 70 of the final heat exchanger plate 16 in the stack 24. The heat exchanger plate 12 is dimensioned so that the flange 74 can be closely received within an upper portion of the flange 70 of the final heat exchanger plate with an outer surface of the flange 74 overlapping with an inner surface of the flange 70 as illustrated in FIG. 3. Brazing material 92 sealably secures the flanges 70 and 74 about their respective perimeters. Reinforcing plate 14 is brazed to an inner surface of the end plate central planar portion 72, and to the raised boss portions of plate 16, and to the turbulizer plate 22. As noted-above, a final fluid flow channel 30 is defined between the reinforcing plate 14 and the final heat exchanger plate in the stack 24. In the illustrated embodiment, the final fluid flow channel 30 is a fluid flow channel for the second fluid, however, in different configurations it could act as a flow channel for the first fluid. The planar support portion 46 of the boss 62 sealingly engages the reinforcing plate 14, thereby ensuring the first fluid flow chamber 88 is not in communication with the final fluid flow channel 30. Similarly, the planar support portion of the second boss 64 of the final heat exchanger plate 16 also sealingly engages the reinforcing plate 14.

Reinforcing plate 14 and end plate 12 provide the combined strength required to resist the pressure present at the top end of the plate stack 24. Similarly, connector plate 20 reinforces the bottom end of the stack 24 to provide the required strength at such end. The combined use of an end plate 14 and reinforcing plate 12 can result in more pressure resistance than a single plate of the same thickness as the overlap joint formed between flanges 74 and 70 tends to be stronger than the butt joint that would exist if a thicker single plate were used in place of separate plates 12 and 14.

In the illustrated embodiment, the flange 74 projects from the inner surface of the planar central end portion 72 a distance substantially equal to the thickness of the reinforcing plate 14. Such a configuration permits the turbulizer plate 22 in the final fluid flow channel 30 to extend relatively close to inner surface of the portion of flange 70 that defines the periphery of the flow channel 30.

Referring to FIG. 1, the error proofing hole 76 through the end plate 12 is provided to allow error proofing to be carried out to ensure that the reinforcing plate 14 has been properly installed in the heat exchanger 10 during its assembly. In one embodiment, the hole 76 is preferably large enough to allow a person to visually verify, by looking through the hole, that the reinforcing plate 14 is present. At the same time, the hole 76 is preferably small enough so as to avoid affecting the structural integrity or strength of the end plate 12. In addition to providing a visual check, the error proofing hole 76 can also provide a functional verification that the reinforcing plate 14 is sealably located in place during a test in which a test fluid under pressure is forced into the final fluid flow channel 30. If any of the test fluid leaks out through the error proofing hole 76, a problem condition such as a missing reinforcing plate or a leak path between the end plate and the reinforcing plate is indicated. It will be understood that more than one error proofing hole could be provided through the end plate 12.

In one possible use of the heat exchanger 10, a first fluid enters the heat exchanger 10 through port 78 and flows in parallel through the first fluid flow channels 26, and subsequently out of the heat exchanger through the port 82 in connecting plate 20. A second fluid enters the heat exchanger through fluid port 80, and flows in parallel through each of the second fluid flow channels 28 and the final fluid flow channel 30, and leaves the heat exchanger 10 through the fluid port 84 in connector plate 20. In such a manner, heat is exchanged between the two fluids as they flow through the alternating flow channels of the stack 24.

It will thus be appreciated that the present invention provides a stacked-dish plate-type heat exchanger in which the final dish heat exchanger plate in the stack is actively used in the heat exchanging process, thereby eliminating any unused space. The overlapping joint between the end plate and the final dish heat exchanger plate provides a pressure resistant configuration. The exposed edge of the flange of the last heat exchanger plate in the stack is minimized. In the illustrated example, as shown in FIG. 3, the end plate 12 is substantially flush with an upper edge of the flange 70, thereby reducing the chance of injury occurring due to a protruding flange.

It will be appreciated that a number of variations from the described embodiment are possible. For example, the plates have been illustrated as rectangular, however, different plate configurations could be used in conformance with the present invention, such as circular or oblong-shaped plates. The alternating flow channels have been illustrated as having the same height. However, the alternating plates could have different flange heights so that the alternating flow channels have correspondingly different heights. In some configurations, separate collars could be used in the place of bosses 62, 64, 40 and 42. The locations of the flow openings and bosses could be varied, for example, the flow openings through each plate could be longitudinally positioned relative to each other rather than diagonally located, or could be located side-by-side, separated by a barrier forcing an indirect U-shaped flow path.

The turbulizer plates 22 could extend from end-to-end of the heat exchanger, or could terminate prior to the flow openings. In some embodiments, integrally formed dimples or ribs on plates 16, 18 could be used in the place of turbulizer plates 22 for flow augmentation and structural support, and in some embodiments turbulizers 22 may be entirely omitted from some or all of the flow channels. Although the heat exchanger has been described above from the point of view of handling two heat transfer fluids, it will be appreciated that more than two fluids can be accommodated simply by nesting or expanding around the described structures using principles similar to those described above. In some embodiments, the reinforcing plate may not be required so long as the end plate 12 is thick enough or otherwise sufficiently supported to withstand any pressure applied to it. In some embodiments, the reinforcing plate 14 may dimpled or ribbed or be formed with rippled convolutions.

Although embodiments of the heat exchanger described above have included a core stack of a plurality of dish-type plates 16, 18, with a final inverted dish-type end plate 12, in some embodiments the inverted dish-type end plate 12 could be used, with or without reinforcing plate 14, and with or without a turbulizer 22, in combination with just a single dish-type plate 16 or 18 (in which case the dish-type place 16 or 18 need not have raised bosses with openings formed therethrough). Such a configuration could be used, for example, for a low-profile heat exchanger having a single enclosed fluid flow channel between the end plate 12 and the adjacent single dish-type plate 16 or 18.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A stacked plate-type heat exchanger including:

a plurality of dish-shaped heat exchanger plates arranged one next to the other to form a nested heat exchanger plate stack, each of the heat exchanger plates having a planar central portion with a peripheral flange projecting therefrom;

a plurality of first and second fluid flow channels formed between the heat exchanger plates for first and second fluids respectively;

first fluid and second fluid chambers formed in the stack in communication with the first and second fluid channels respectively;

an end plate with an end plate central planar portion and a peripheral flange projecting from the end plate central planar portion, the peripheral flange of the end plate projecting in an opposite direction and sealably nested within the peripheral flange of a final heat exchanger plate in the plate stack; and a planar reinforcing plate secured to an inner surface of the end plate central planar portion between the end plate central planar portion and the final heat exchanger plate, a further fluid channel for one of the first and second fluids being located between the planar reinforcing plate and the final heat exchanger plate.

2. The heat exchanger of claim 1 wherein the reinforcing plate covers substantially the entire inner surface of the end plate central planar portion.

3. The heat exchanger of claim 2 wherein an error proofing hole is provided through the end plate central planar portion in a location such that an inner side of the error proofing hole is sealably covered by the reinforcing plate, the error proofing hole permitting confirmation that the reinforcing plate is present.

4. The heat exchanger of claim 3 wherein the error proofing hole is appropriately sized to permit visual confirmation that the reinforcing plate is present.

5. The heat exchanger of claim 4 wherein the error proofing hole is appropriately sized to permit a test fluid to pass therethrough from the further fluid channel if the reinforcing plate is not present.

6. The heat exchanger of claim 2 wherein the reinforcing plate is thicker than the end plate central planar portion.

7. The heat exchanger of claim 2 wherein the peripheral flange of the end plate projects from an inner surface of the end plate central planar portion a distance that is substantially equal to the thickness of the planar reinforcing plate.

8. The heat exchanger of claim 2 including flow augmentation means located in at least some of the flow channels and further flow channels for augmenting fluid flow therethrough.

9. The heat exchanger of claim 8 wherein the flow augmentation means includes turbulizer plates located in the flow channels and the further flow channel.

10. The heat exchanger of claim 1 wherein an outer surface of the peripheral flange of the end plate overlaps with an inner surface of the peripheral flange of the final heat exchanger plate, the overlapping surfaces being sealably joined together.

11. A stacked plate-type heat exchanger comprising:

a plurality of heat exchanger plates sealably secured together to form a stack, each of the heat exchanger plates having a planar central portion and inlet and outlet passages for fluid passage, a plurality of fluid channels being defined between the planar central portions, some of the fluid channels being channels for a first fluid and some of the fluid channels being channels for a second fluid to facilitate heat exchange between the first and second fluids, at least a final heat exchanger plate in the stack having a peripheral flange projecting from the planar central portion thereof;

an end plate having an end plate central planar portion and a peripheral flange projecting from the end plate central planar portion, the peripheral flange of the end plate projecting in an opposite direction and sealably located within and secured to the peripheral flange of the final heat exchanger plate, a further fluid channel for one of the first and second fluids being located between the end plate and the final heat exchanger plate; and a reinforcing plate secured to an inner surface of the end plate central planar portion that faces the planar central portion of the final heat exchanger plate, the further fluid channel being located between the reinforcing plate and the final heat exchanger plate.

12. The stacked plate-type heat exchanger of claim 11 wherein the reinforcing plate covers substantially the entire inner surface of the end plate central planer portion.

13. The stacked plate-type heat exchanger of claim 11 wherein an error proofing hole is provided through the end plate central planar portion in a location such that an inner side of the error proofing hole is sealably covered by the reinforcing plate, the error proofing hole permitting confirmation that the reinforcing plate is present.

14. The stacked-plate type heat exchanger of claim 12 wherein the reinforcing plate, end plate and heat exchanger plates are secured together by braze or solder.

15. The stacked-plate type heat exchanger of claim 11 wherein an outer surface of the peripheral flange of the end plate overlaps with an inner surface of the peripheral flange of the final heat exchanger plate, the overlapping surfaces being sealably joined together.

16. A heat exchanger including a first plate having a central planer portion and a peripheral flange projecting therefrom, a second plate having a central planar portion and a peripheral flange projecting therefrom, and a reinforcing plate secured to substantially an entire inner surface of the central planar portion of the second plate, an inner surface of the central planar portion of the first plate spaced apart from and opposing the reinforcing plate and the peripheral flange of the second plate projecting in an opposite direction than the peripheral flange of the first plate and having an outer surface that overlaps with an inner surface of the peripheral flange of the first plate, the overlapping surfaces being sealably joined together, a fluid flow channel having a flow inlet and a flow outlet being defined by the first and second plates and reinforcing plate.

17. A stacked plate-type heat exchanger comprising:

a plurality of heat exchanger plates sealably secured together to form a stack, each of the heat exchanger plates having a planar central portion and inlet and outlet passages for fluid passage, a plurality of fluid channels being defined between the planar central portions, some of the fluid channels being channels for a first fluid and some of the fluid channels being channels for a second fluid to facilitate heat exchange between the first and second fluids, at least a final heat exchanger plate in the stack having a peripheral flange projecting from the planar central portion thereof, the inlet and outlet passages of each of the heat exchanger plates being openings formed through spaced apart portions of the planer central portions thereof, the heat exchanger plates further including first and second spaced apart bosses extending from a surface of the planar central portion in the same direction as the peripheral flange of the final heat exchanger plate, each of the bosses having a planar support surface surrounding a flow opening, the heat exchanger plates being arranged so that the flow opening through the first boss in each heat exchanger plate is aligned with the inlet passage in an adjacent heat exchanger plate with the planar support surface of the first boss sealingly engaging the adjacent heat exchanger plate about the inlet passage, and the flow opening through the second boss in each heat exchanger plate is aligned with the outlet passage in the adjacent heat exchanger plate with the planar support surface of the second boss sealingly engaging the adjacent heat exchanger plate about the outlet passage, the aligned flow openings and passages providing first inlet and first outlet flow chambers for the first fluid to enter and exit, respectively, the fluid channels for the first fluid, and second inlet and second outlet flow chambers for the second fluid to enter and exit, respectively, the fluid channels for the second fluid, the fluid channels for the first and second fluids alternating throughout the stack;

an end plate having an end plate central planar portion and a peripheral flange projecting from the end plate central planar portion, the peripheral flange of the end plate projecting in an opposite direction and sealably located within and secured to the peripheral flange of the final heat exchanger plate, a further fluid channel for one of the first and second fluids being located between the end plate and the final heat exchanger plate; and a base plate connected to a first heat exchanger plate in the stack for mounting the heat exchanger to a support surface, the base plate having first fluid inlet and outlet passages and second fluid inlet and outlet passages formed therethrough in communication with the respective first inlet and first outlet flow chambers and second inlet and second outlet flow chambers.

* * * * *